US006554221B2

(12) United States Patent
Hinds

(10) Patent No.: US 6,554,221 B2
(45) Date of Patent: Apr. 29, 2003

(54) CABLE UNWINDING SYSTEM AND METHOD

(76) Inventor: Cecil R. Hinds, 2481 Cherry St., Bossier City, LA (US) 71112

( * ) Notice: Subject to any disclaimer, the term of this patent is extended or adjusted under 35 U.S.C. 154(b) by 0 days.

(21) Appl. No.: 09/898,934

(22) Filed: Jul. 3, 2001

(65) Prior Publication Data

US 2002/0003186 A1 Jan. 10, 2002

Related U.S. Application Data

(60) Provisional application No. 60/216,488, filed on Jul. 6, 2000.

(51) Int. Cl.[7] ..... B65H 16/00

(52) U.S. Cl. ..... 242/557; 242/550; 242/564.3; 254/134.3 R

(58) Field of Search ..... 242/557, 564.3, 242/550; 254/134.3 R; 24/136 R; 294/102.1

(56) References Cited

U.S. PATENT DOCUMENTS

| | | | | | |
|---|---|---|---|---|---|
| 4,042,187 | A | * | 8/1977 | Snyder | 242/557 |
| 4,437,622 | A | | 3/1984 | Heider | 242/86.5 |
| 4,635,983 | A | | 1/1987 | Boland et al. | 293/111.1 |
| 4,643,370 | A | | 2/1987 | Pierce | 242/86.7 |
| 4,643,397 | A | | 2/1987 | Munns | 254/134.3 |
| 4,726,566 | A | | 2/1988 | Boland et al. | 254/325 |
| 4,871,127 | A | * | 10/1989 | Clark | 254/134.3 R |
| 5,156,355 | A | * | 10/1992 | Wadle | 242/557 |
| 5,167,399 | A | * | 12/1992 | Delomel | 254/134.3 R |
| 5,322,132 | A | * | 6/1994 | Frank | 24/136 R |
| 5,325,746 | A | * | 7/1994 | Anderson | 24/136 R |
| 5,582,216 | A | * | 12/1996 | Smith et al. | 242/557 |
| 5,632,470 | A | | 5/1997 | Leland | 254/385 |
| 5,904,314 | A | * | 5/1999 | Babcock | 242/557 |

FOREIGN PATENT DOCUMENTS

| | | | | |
|---|---|---|---|---|
| JP | 03289308 A | * | 12/1991 | 254/134.3 R |

* cited by examiner

*Primary Examiner*—Kathy Matecki
*Assistant Examiner*—Sang Kim
(74) *Attorney, Agent, or Firm*—John M. Harrison

(57) ABSTRACT

A system and method for unwinding cable from a cable spool typically using an all-terrain vehicle. The cable spool is typically rotatably mounted on a conventional jackstand provided on a trailer, and the cable unwinding system includes a roller drum rotatably mounted on the conventional rear rack of the all-terrain vehicle. According to the method of the invention, the free end of the cable is initially extended from the cable spool and looped around the roller drum, and a tether provided on the trailer or jackstand is removably fastened to the free end portion of the cable on one side of the roller drum. As the all-terrain vehicle is driven away from the cable spool, the roller drum pulls the cable from the cable spool as the rotating cable spool dispenses the cable. After a selected length of cable has been removed from the cable spool, the all-terrain vehicle is stopped and re-positioned for pulling another segment of cable from the spool. The unwound segments of cable are positioned on the ground in parallel, adjacent relationship to each other and the procedure is repeated until the desired length of cable has been pulled from the cable spool.

14 Claims, 4 Drawing Sheets

CABLE UNWINDING SYSTEM AND METHOD

CROSS-REFERENCE TO RELATED APPLICATIONS

This application claims the benefit of copending U.S. Provisional Application Ser. No. 60/216,488, filed Jul. 6, 2000.

BACKGROUND OF THE INVENTION

1. Field of the Invention

This invention relates to devices for stringing cable from spools and more particularly, to a system and method for unwinding fiber optic cable from a cable spool using a vehicle, particularly an all-terrain vehicle, which cable spool is typically rotatably mounted on a jackstand which is free-standing or provided on a trailer or truck. In a preferred embodiment the cable unwinding system includes a roller drum which is rotatably mounted on a roller drum frame provided on the conventional rear rack of the all-terrain vehicle. According to the method of the invention, the free end of the cable is initially extended from the cable spool and looped around the roller drum. A tether provided on the trailer, truck or jackstand is removably fastened to the free end portion of the cable on one side of the roller drum, and as the all-terrain vehicle is driven away from the cable spool, the roller drum pulls the cable from the cable spool as the rotating cable spool dispenses the cable. After a selected length of cable has been unwound from the cable spool, the all-terrain vehicle is stopped, the cable is removed from the roller drum, the vehicle is re-positioned adjacent to the spool, the cable is again looped around the roller drum and tethered to the trailer and the vehicle is driven away from the cable spool to pull a second cable segment from the spool. The extended segments of cable are positioned on the ground in parallel, adjacent relationship to each other and the procedure is repeated until the desired length of cable has been pulled from the cable spool.

Fiber optic cables are used extensively in the cable television industry to transmit electronic signals to homes and businesses. When new residential subdivisions are developed, miles of fiber optic cable must be distributed to these areas either above or below ground, or both, to provide cable television service to the new homes. Typically, the fiber optic cable is wound on a cable spool which is rotatably mounted on a jackstand provided on a trailer or cable truck. Usually, the cable must be unwound from the cable spool by manually grasping and pulling the cable from the spool as the spool rotates and dispenses the cable. However, this is a very time-consuming and labor-intensive operation and may cause blistering and other discomfort to the person or persons charged with the cable unwinding operation. Accordingly, a method is needed for quickly and easily removing extensive lengths of fiber optic cable from cable spools.

2. Description of the Prior Art

Various devices are known in the art for dispensing cable from a cable spool or other medium or installing cable in the ground. Typical of these devices is the "Wire Roller", described in U.S. Pat. No. 4,437,622, dated Mar. 20, 1984, to Heider. The wire roller is designed to dispense wire from a spool for construction of a new fence or to take up wire removed from an existing fence, and the spool is rotatably supported on a frame which is adapted for support on a vehicle. An electric motor is provided on the frame for rotating the spool. The frame may be mounted on the bumper of the vehicle by means of a clamp assembly which includes a pair of coacting clamp jaws pivotally connected by an adjustable connection for accommodating vehicle bumpers of various dimensions. U.S. Pat. No. 4,635,983, dated Jan. 13, 1987, to Boland, et al., details a "Rear Bumper Assembly for Cable Pulling Truck" including a pair of telescoping outrigger supports, each of which carries at its outer end an upstanding vertical support tube for receiving the shaft of a winch motor. Each support further includes a hand-operated jack assembly pivotally movable between storage and use positions. Multiple hydraulic and electrical couplers are provided on the jack assembly for connecting the assembly to hydraulic and electrical systems of the truck. A "Wheeled Vehicle for Stringing a Cable" is described in U.S. Pat. No. 4,643,370, dated Feb. 17, 1987, to Pierce. The vehicle is used for stringing cable from a spool which is rotatably mounted on the vehicle. A motor may be used to rotate the spool, and a multibrake system may be used to inhibit the rotation of the spool. The multibrake system includes a variable, light-resistance brake capable of being activated when the vehicle is either moving or parked and includes a nonvariable, strong resistance brake capable of being actuated only when the vehicle's parking brakes are used. When the spool is rotated to take in or dispense cable, the strong resistance brake is automatically disengaged, and automatically reapplied when rotation of the spool ceases. An "Off-Road Vehicle Fairlead Assembly for Fibre-Optic Communication Cable" is disclosed in U.S. Pat. No. 4,643,397, dated Feb. 17, 1987, to Munns. The assembly is adapted for guiding fiber-optic cable from a reel rotatably supported on the boom assembly of a vehicle to the feed tube of a shank attached to the hitch of the vehicle. A first fairlead assembly is fixably mounted on the top of the vehicle cab and includes a housing which defines an open-ended chamber having chamber openings. Each chamber opening has multiple rollers positioned such as to form a convergence inwardly to the chamber. A second fairlead assembly, characterized by vertical sidewalls mounted on a base and having multiple rollers rotatably mounted between the sidewalls, is fixably mounted on the shank for directing cable to the shank feed tube. U.S. Pat. No. 4,726,566, dated Feb. 23, 1988, to Boland, et al., discloses a "Truck-Mounted Cable Pulling System" characterized by an equipment module for use in a cable-pulling system which includes a pickup truck having a hydraulic drive system. The module includes a frame adapted to be removably mounted on the pickup truck, a hydraulic control console mounted on the frame and adapted to be coupled to the hydraulic drive system of the truck, a hydraulic winch motor, first support means mounted on the frame for removably supporting the winch motor in a storage position, a cable take-up reel, and second support means mounted on the frame for removably supporting the reel in a storage position. U.S. Pat. No. 5,632,470, dated May 27, 1997, to Leland, details a "Wire Fencing Apparatus" having a generally rectangular open frame carriage mounted on a standard three-way hitch on the rear end of a tractor. A pair of hydraulic cylinders mounted on the frame each has a pulley attached to the top of the upwardly-extendible piston thereof, which pulley receives a strand of fence wire. The pulleys operate to tension the separate strands of wire in opposite directions, as well as single strands from either direction of the apparatus.

An object of this invention is to provide a system and method for unwinding cable from a cable spool using a vehicle.

Another object of this invention is to provide a system for unwinding fiber optic cable from a rotatable cable spool typically using an all-terrain vehicle, which system includes a roller drum mounted on the all-terrain vehicle for receiving the cable and wherein the all-terrain vehicle is driven away from the cable spool to unwind the cable from the cable spool as the cable spool rotates and dispenses the cable.

Still another object of this invention is to provide a system and method for unwinding fiber optic cable from a cable spool typically rotatably mounted on a free-standing or trailer- or truck-mounted jackstand, which system is characterized by a roller drum rotatably mounted on the conventional rear rack of an all-terrain vehicle, wherein the cable is initially looped around the roller drum; the free end portion of the cable on one side of the roller drum is tethered to the jackstand, trailer or truck; and the cable is unwound from the cable spool by driving the all-terrain vehicle away from the jackstand, trailer or truck. The all-terrain vehicle is repositioned and the cable-unwinding operation repeated as desired to facilitate unwinding a selected length of cable from the cable spool, with multiple segments of the cable lying on the ground in parallel, adjacent relationship with respect to each other.

SUMMARY OF THE INVENTION

These and other objects of the invention are provided in a cable unwinding system and method for unwinding fiber optic cable from a cable spool typically using a four-wheeled all-terrain vehicle, which conventional cable spool is typically rotatably mounted on a conventional free-standing or trailer- or truck-mounted jackstand. In a preferred embodiment the cable unwinding system includes a roller drum which is rotatable mounted on a roller drum frame provided on the conventional rear rack of the all-terrain vehicle. According to the method of the invention, the free end of the cable is initially extended from the cable spool and looped around the roller drum. A tether provided on the trailer, jackstand or truck is removably fastened to the free end portion of the cable on one side of the roller drum, and as the all-terrain vehicle is driven away from the cable spool, the roller drum pulls the cable from the cable spool as the rotating cable spool dispenses the cable on the other side of the roller drum. After a selected length of cable has been unwound from the cable spool, the all-terrain vehicle is stopped, the cable is removed from the roller drum, the vehicle is re-positioned adjacent to the cable spool, the cable is again looped around the roller drum and tethered to the trailer, jackstand or truck and the vehicle is driven away from the cable spool to pull a second cable segment from the spool. The cable unwinding procedure is repeated as desired to facilitate unwinding a selected length of cable from the cable spool as the extended segments of cable are positioned on the ground in parallel, adjacent relationship to each other.

BRIEF DESCRIPTION OF THE DRAWINGS

The invention will be better understood by reference to the accompanying drawings, wherein.

DESCRIPTION OF THE PREFERRED EMBODIMENTS

Figure 1:
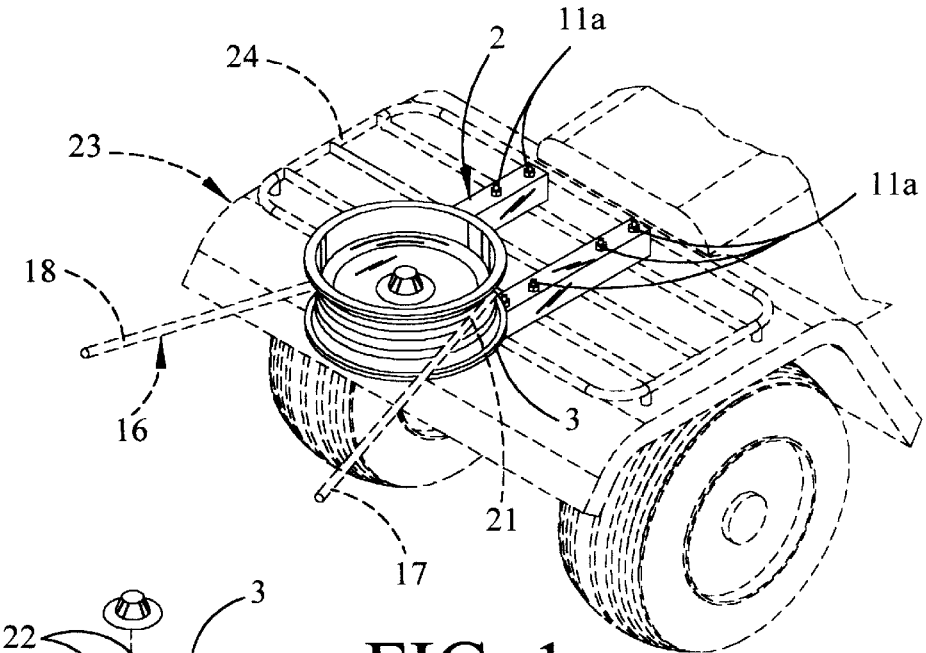
FIG. 1 is a perspective view, partially in section, of a conventional four-wheeled all-terrain vehicle (illustrated in phantom), with the drum frame element of the cable unwinding system and method of this invention mounted on the rear rack of the all-terrain vehicle, the roller drum element of the invention rotatably mounted on the drum frame and a cable (illustrated in phantom and partially in section) looped around the roller drum.
Figure 2:
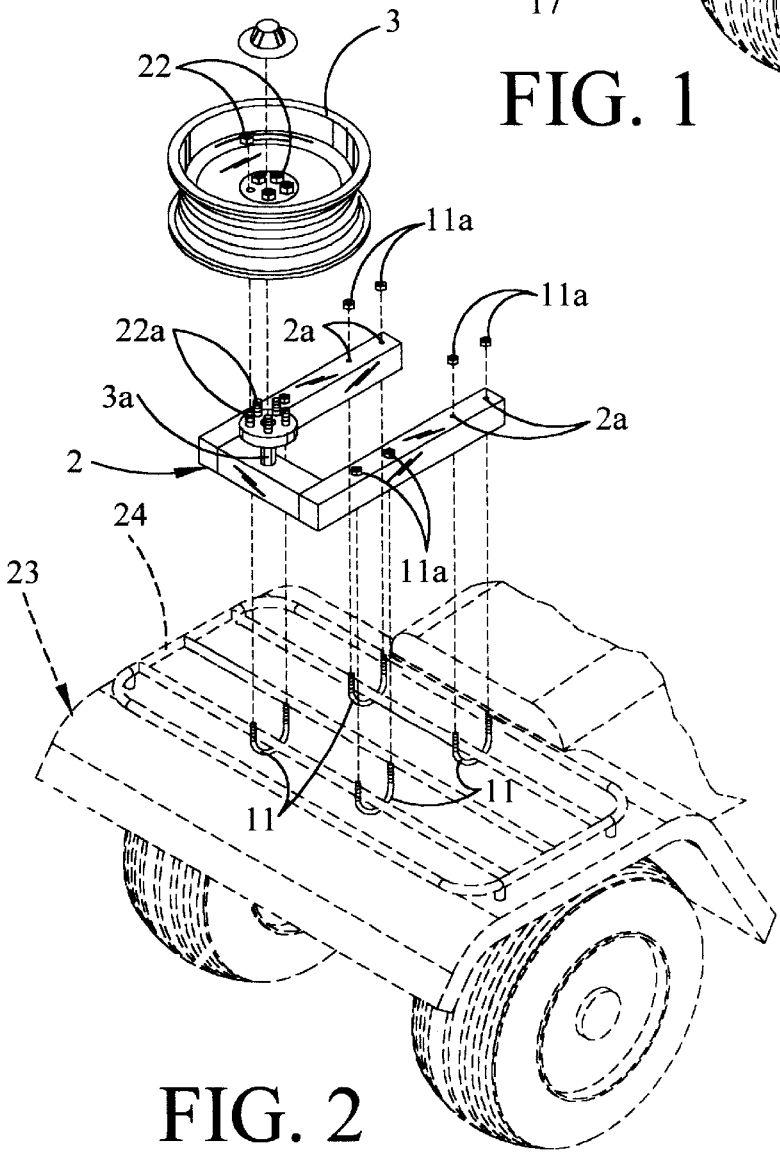
FIG. 2 is an exploded, perspective view of the drum frame and roller drum elements of the invention illustrated in FIG. 1, more particularly illustrating a preferred, bolt technique for mounting the drum frame on the rear rack of the all-terrain vehicle and rotatably mounting the roller drum on the drum frame.
Figure 3:
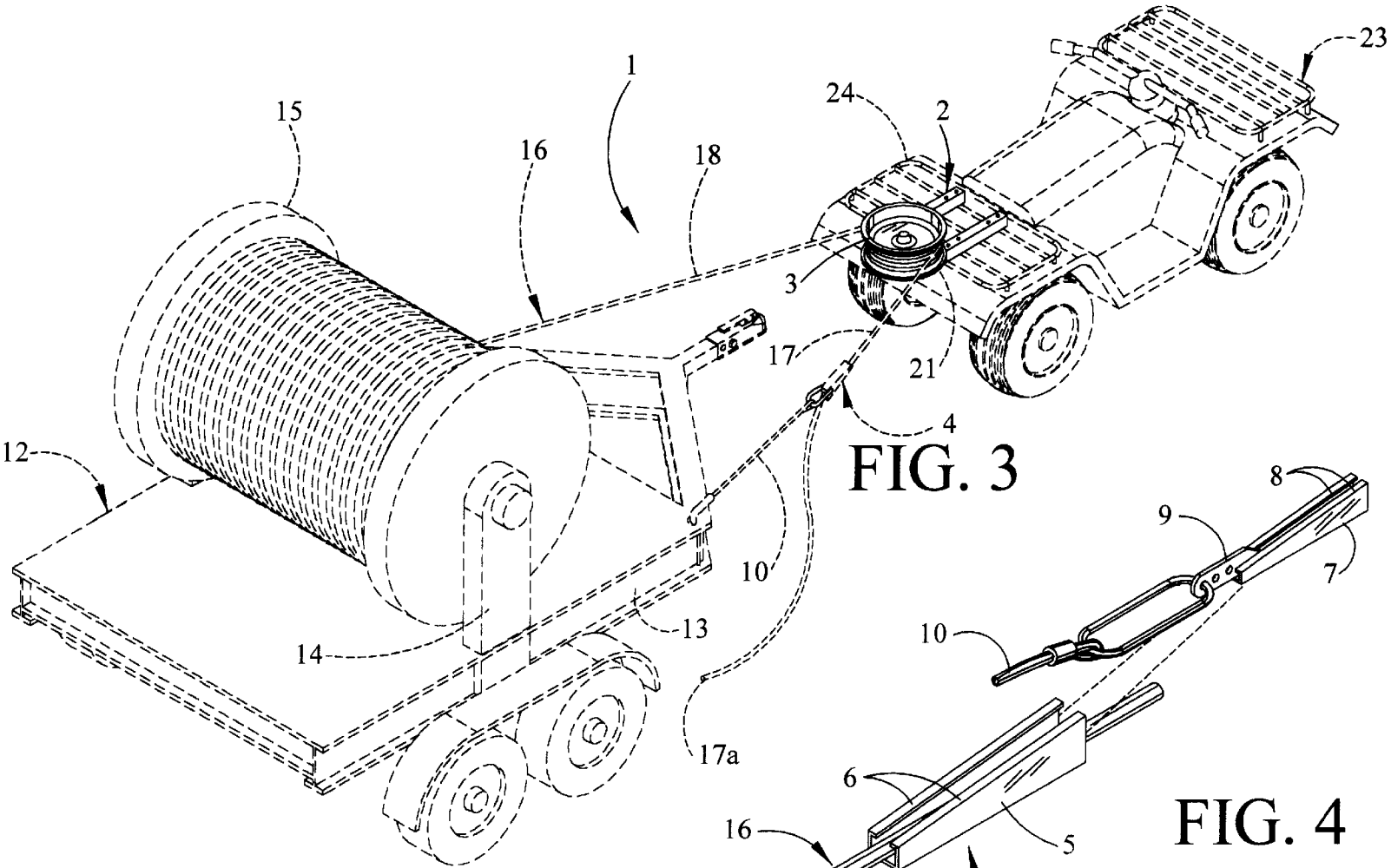
FIG. 3 is a perspective view of an all-terrain vehicle, positioned in front of a conventional cable spool which is rotatably mounted on a jackstand provided on a trailer, with cable, wound on the cable spool, looped around the roller drum element (illustrated in solid lines) of the cable unwinding system of this invention and tethered to the trailer, preparatory to unwinding a first segment of the cable from the cable spool by operation of the all-terrain vehicle.
Figure 4:
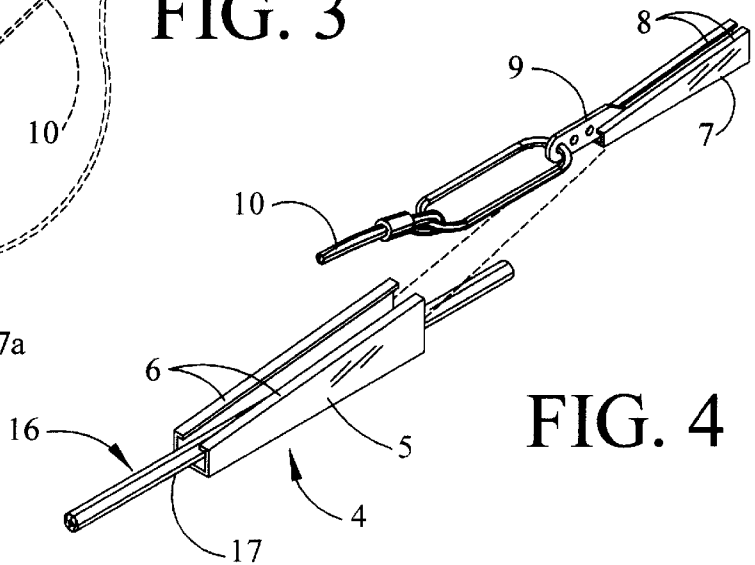
FIG. 4 is an exploded, perspective view, partially in section, of an illustrative cable clamp element of the cable unwinding system, used for tethering the the cable to the trailer in typical application of the cable unwinding system and method.

Referring initially to FIGS. 1–4 of the drawings, in a preferred embodiment the cable unwinding system of this invention is generally illustrated by reference numeral 1. The cable unwinding system 1 is designed to unwind a selected length of typically fiber optic cable 16 from a conventional cable spool 15, rotatably mounted on a jackstand 14 which may be either free-standing (not illustrated) or mounted on the trailer frame 13 of a conventional trailer 12, as illustrated, or on a truck (not illustrated). As illustrated in FIG. 2, the cable unwinding system 1 includes a typically U-shaped drum frame 2, mounted on the conventional rear rack 24 of a typically four-wheeled all-terrain vehicle 23 typically by means of multiple U-bolts 11 which engage the rear rack 24 and are extended through respective pairs of bolt openings 2*a* of the drum frame 2 and receive corresponding pairs of nuts 11*a*. A drum axle 3*a* is rotatably mounted on the drum frame 2, and a roller drum 3 is mounted on the drum axle 3*a* typically by means of multiple axle bolts 22 and respective nuts 22*a*. In application of the cable unwinding system 1 as hereinafter described, the all-terrain vehicle 23 is initially positioned in front of the trailer 12, with the roller drum 3 positioned nearest the trailer frame 13 of the trailer 12. The free end 17*a* of the cable 16 is initially pulled from the cable spool 15, and looped around the roller drum 3 at a cable loop 21 to form a first stationary segment 17 and a first unwinding segment 18 of the cable 16 on opposite sides of the roller drum 3, as illustrated in FIG. 3. The first stationary segment 17 of the cable 16 is tethered to the trailer frame 13 typically by means of a cable tether 10, one end of which is fastened to the trailer frame 13 as further illustrated in FIG. 3. Accordingly, as illustrated in FIG. 4 an attachment flange 9, provided on the elongated clamp sleeve 5 of a cable clamp 4, is attached to the free end of the tether 10, which clamp sleeve 5 typically has a U-shaped cross-sectional configuration with a pair of parallel clamp flanges 6 extending toward each other. The clamp sleeve 5 initially receives the first stationary segment 17 of the cable 16, and an elongated clamp wedge 7, fitted with a pair of parallel, tapered wedge flanges 8, compresses the cable 16 progressively tighter against the clamp sleeve 5 as the clamp wedge 7 is inserted in the clamp sleeve 5 to secure the cable 16 in the clamp sleeve 5. The first stationary segment 17 of the cable 16 is thus secured to the trailer frame 13 and rendered stationary with respect to the all-terrain vehicle 23 as the al-terrain vehicle 23 is subsequently driven away from the trailer 12 to unwind a first unwinding segment 18 of the cable 16 from the cable spool 15, as hereinafter further described. It is understood that any suitable cable clamp known to those skilled in the art can be used for attaching the tether 10 to the cable 16, the cable clamp 4 described above with respect to FIG. 4 designed to facilitate quick connection and disconnection of the tether 10 to the cable 16.

Figure 5:
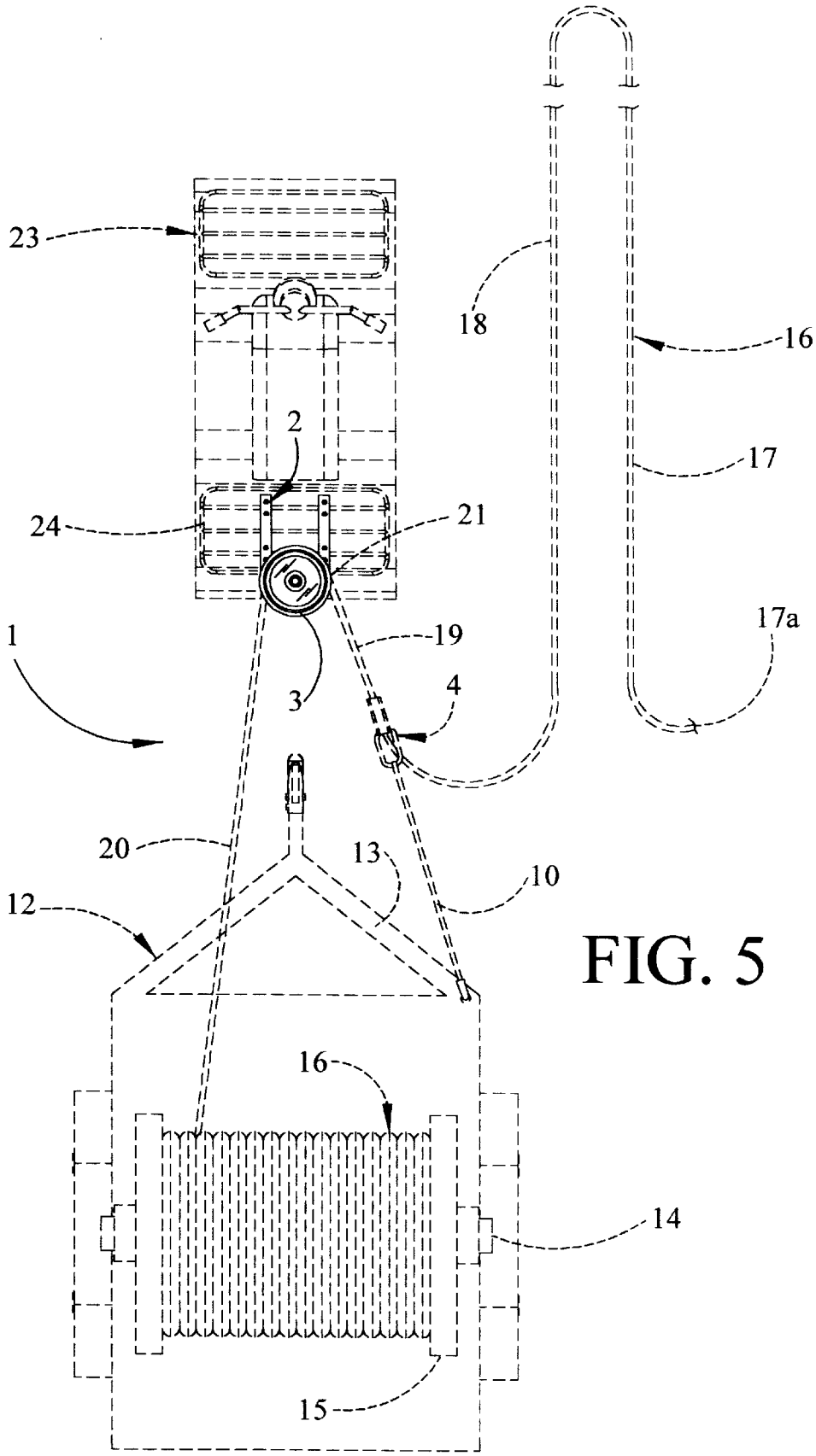
FIG. 5 is a top view of the conventional all-terrain vehicle and trailer, illustrated in phantom, more particularly illustrating repositioning of the all-terrain vehicle in front of the trailer and extension of the cable around the roller drum element (illustrated in solid lines) of the cable unwinding system preparatory to unwinding a second segment of the cable from the cable spool.
Figure 6:
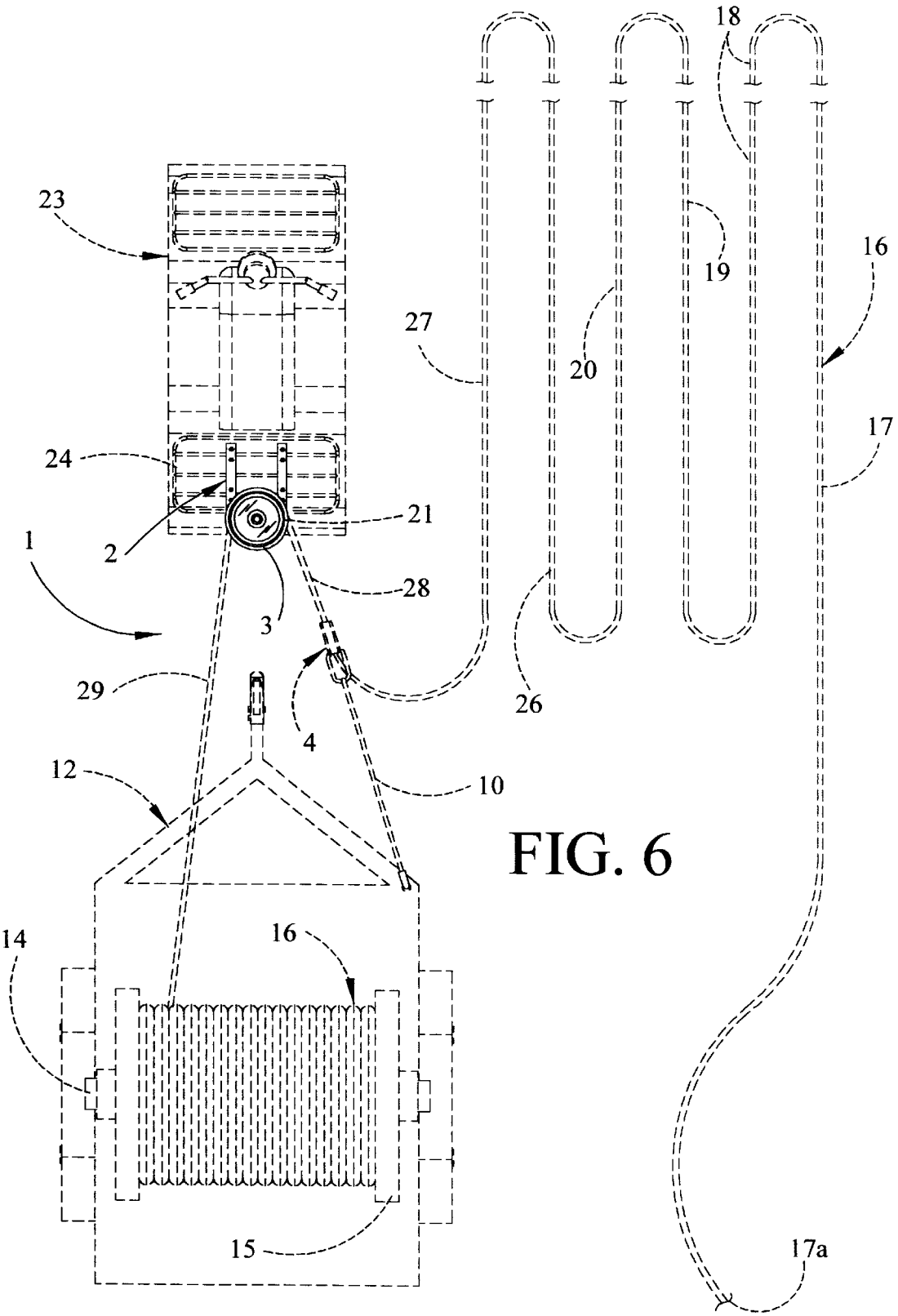
FIG. 6 is a top view of the cable unwinding system, more particularly illustrating repositioning of the all-terrain vehicle in front of the trailer and extension of the cable around the roller drum preparatory to unwinding a fourth segment of the cable from the cable spool.

Referring again to FIG. 3 and to FIGS. 5 and 6 of the drawings, in typical application of the cable unwinding system 1 the all-terrain vehicle 23 is initially positioned in front of the trailer 12 with the roller drum 3 (rotatably mounted on the drum frame 2 on the all-terrain vehicle 23) positioned adjacent to the front end of the trailer frame 13, as illustrated in FIG. 3. The free end 17*a* of the cable 16 is then pulled from the cable spool 15, and the cable 16 is looped around the roller drum 3 at the cable loop 21 and pulled back toward the trailer 13 to define the first stationary segment 17 and first unwinding segment 18 of the cable 16 on opposite sides of the roller drum 3, which first unwinding segment 18 extends from the cable spool 15. The first stationary segment 17 of the cable 16 is then attached to the trailer frame 13 by means of the cable tether 10, by securing the first stationary segment 17 of the cable 16 in the cable clamp 4 as heretofore described with respect to FIG. 4. The all-terrain vehicle 23 is then driven forwardly, away from the trailer 12 and this action causes the roller drum 3 to pull against the cable loop 21 of the cable 16, looped around the cable drum 3, as the cable drum 3 rotates on the drum frame 2. Accordingly, the first stationary segment 17 of the cable 16, attached to the trailer frame 13 by means of the tether 10 and cable clamp 4, remains stationary with respect to the all-terrain vehicle 23 as the all-terrain vehicle 23 is driven away from the trailer 12 and the roller drum 3 pulls and unwinds the first unwinding segment 18 of the cable 16 from the cable spool 15 and the cable spool 15 rotates in the jackstand 14 to dispense the cable 16 from the cable spool 15. After a desired length of the first unwinding segment 18 of the cable 16 has been unwound from the cable spool 15, the all-terrain vehicle 23 is stopped and the cable 16 is removed from the roller drum 3. The extended stationary end segment 17 and first unwinding segment 18, unwound from the cable 16, are rested on the ground, the all-terrain vehicle 23 is re-positioned in front of the trailer 12 as illustrated in FIG. 5 and the cable clamp 4 is removed from the first stationary segment 17 of the cable 16. A short segment of the cable 16 is next manually unwound from the cable spool 15 and looped around the roller drum 3 at a cable loop 21 to define a second stationary segment 19 and a second unwinding segment 20 on opposite sides of the roller drum 3, as further illustrated in FIG. 5. The cable tether 10 is attached to the second stationary segment 19 of the cable 16 by operation of the cable clamp 4 as heretofore described with respect to FIG. 3, and the all-terrain vehicle 23 is again driven forwardly, away from the trailer 12 to facilitate unwinding the second unwinding segment 20 from the cable spool 15, in the same manner as heretofore described with respect to the first segment 18 illustrated in FIG. 3. After the desired length of the second unwinding segment 20 has been unwound from the cable spool 15, the all-terrain vehicle 23 is stopped and the cable 16 is again removed from the roller drum 3. The all-terrain vehicle 23 is then repositioned in front of the trailer 12 and the procedure is repeated as illustrated in FIG. 6, to define a third stationary segment 26 and third unwinding segment 27 unwound from the cable spool 15 and lying on the ground in parallel relationship to the first stationary segment 17, first unwinding segment 18, second stationary segment 19 and second unwinding segment 20, with a fourth stationary segment 28 and fourth unwinding segment 29 looped around the roller drum 3 to be unwound from the cable spool 15. The cable unwinding procedure is repeated until all or a selected length of the cable 16 has been extended from the cable spool 15.

It will be appreciated by those skilled in the art that the cable unwinding system and method of this invention is capable of quickly and conveniently unwinding cables of every description from a rotatable cable spool, without the necessity of manually pulling the cable from the spool. It is understood that while the roller drum can be mounted on any type of vehicle to facilitate pulling the cable from the cable spool, the all-terrain vehicle is preferred since all-terrain vehicles are highly maneuverable.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A cable unwinding system for unwinding cable from a cable spool using a vehicle, comprising a roller drum for attachment to the vehicle and wherein the cable is looped around said roller drum to form a stationary segment and an unwinding segment of the cable, and further comprising a tether for engaging this stationary segment of the cable and rendering the stationary segment of the cable stationary with respect to the vehicle; and the cable is unwound from the cable spool, as the vehicle is driven away from the cable spool.

2. The cable unwinding system of claim 1 comprising a cable clamp terminating said tether for removably engaging the stationary segment of the cable.

3. A cable unwinding system for unwinding cable from a cable spool using a vehicle, said cable unwinding system comprising a drum frame for mounting on the vehicle; a roller drum mounted on said drum frame for removably engaging the cable, wherein the cable is looped around said roller drum to form a stationary segment and an unwinding segment of the cable; and a tether for removably engaging the stationary segment of the cable and rendering the stationary segment of the cable stationary with respect to the vehicle, whereby the unwinding segment of the cable is unwound from the cable spool as the vehicle is driven away from the cable spool.

4. The cable unwinding system of claim 3 comprising a cable clamp provided on said tether for removably engaging the stationary segment of the cable.

5. The cable unwinding system of claim 4 wherein said cable clamp comprises a clamp sleeve provided on said tether for receiving the stationary segment of the cable and a clamp wedge slidably disposed in said clamp sleeve for compressing the cable against said clamp sleeve.

6. A method of unwinding a cable from a cable spool using a vehicle, comprising:

(a) providing a cable engaging mechanism on the vehicle;

(b) looping the cable around said cable engaging mechanism to form a stationary segment and an unwinding segment of the cable, and comprising rendering the stationary segment of the cable stationary with respect to the vehicle; and (c) driving the vehicle away from the cable spool.

7. The method of claim 6 wherein said providing a cable engaging mechanism on the vehicle comprises mounting a roller drum frame on the vehicle and mounting a roller drum on said roller drum frame.

8. The method of claim 6 wherein the cable spool is rotatably mounted on a jackstand, and wherein said rendering the stationary segment of the cable stationary with respect to the vehicle comprises providing a tether on the jackstand; providing a cable clamp on said tether; and removably attaching said cable clamp to the stationary segment of the cable.

9. The method of claim 8 wherein said providing a cable engaging mechanism on the vehicle comprises mounting a roller drum frame on the vehicle and rotatably mounting a roller drum on said roller drum frame, and wherein said looping the cable around said cable engaging mechanism comprises looping the cable around said roller drum.

10. The method of claim 8 comprising disengaging the cable from said cable engaging mechanism after said driving the vehicle away from the cable spool, repositioning the vehicle, re-engaging the cable with said cable engaging mechanism and driving the vehicle away from the cable spool.

11. The method of claim 10 wherein said providing a cable engaging mechanism on the vehicle comprises mounting a roller drum frame on the vehicle and rotatably mounting a roller drum on said roller drum frame, and wherein said looping the cable around said cable engaging mechanism comprises looping the cable around said roller drum.

12. The method of claim 6 comprising disengaging the cable from said cable engaging mechanism after said driving the vehicle away from the cable spool, repositioning the vehicle, re-engaging the cable with said cable engaging mechanism and driving the vehicle away from the cable spool.

13. The method of claim 12 wherein said causing removable engagement of the cable with said cable engaging mechanism comprises looping the cable around said cable engaging mechanism to form a stationary segment and an unwinding segment of the cable, and comprising rendering the stationary segment of the cable stationary with respect to the vehicle.

14. The method of claim 13 wherein said providing a cable engaging mechanism on the vehicle comprises mounting a roller drum frame on the vehicle and rotatably mounting a roller drum on said roller drum frame, and wherein said looping the cable around said cable engaging mechanism comprises looping the cable around said roller drum.

* * * * *